US006089918A

United States Patent [19]

Arakelian et al.

[11] Patent Number: 6,089,918

[45] **Date of Patent: *Jul. 18, 2000**

[54] ADAPTER FOR ELECTRICAL CIRCUIT COMPONENTS

[75] Inventors: Baris Carl Arakelian, Belleville; Jerome Adam David Duhr, Plymouth; Jeromy William Tomlin, Berkley; Martin Gerard Morse, Livonia, all of Mich.

[73] Assignees: Yazaki Corporation, Tokyo, Japan; Chrysler Corporation, Auburn Hills, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/885,548

[22] Filed: Jun. 30, 1997

[51] Int. Cl.[7] ..... H01R 13/68

[52] U.S. Cl. ..... 439/621; 439/651

[58] Field of Search ..... 439/622, 621, 439/651, 652

[56] References Cited

U.S. PATENT DOCUMENTS 5,281,171 1/1994 Job ..... 439/621

5,667,389 9/1997 Kidd et al. ..... 439/651

FOREIGN PATENT DOCUMENTS 6150806 5/1994 Japan .

*Primary Examiner*—Gary F. Paumen

*Attorney, Agent, or Firm*—Young & Basile, P.C.

[57] ABSTRACT

An adapter for mating two or more electrical circuit components to a power distribution box receptacle designed to receive a relay or other circuit component having at least four terminals. The adapter includes a hollow body formed of an electrically non-conductive material, a plurality of contacts disposed within the interior of the body, and means for positioning and frictionally engaging the circuit components so as to retain them within the adapter and with their terminals in electrical connection with the contacts. The contacts are in electrical connection with respective adapter terminals projecting from the adapter body in a configuration substantially identical with the terminals of the circuit component which the adapter replaces, so that the adapter terminals are matable with the receptacle to place the components in connection with circuitry internal to the power distribution box.

6 Claims, 2 Drawing Sheets

FIG-2
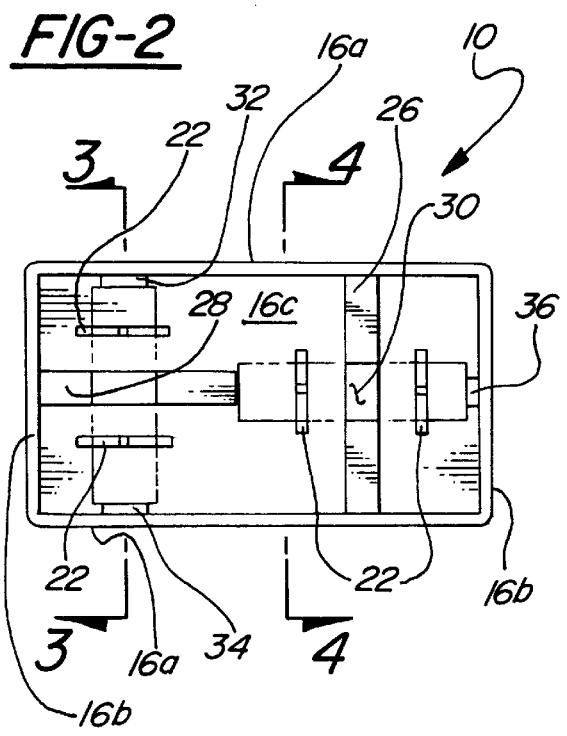
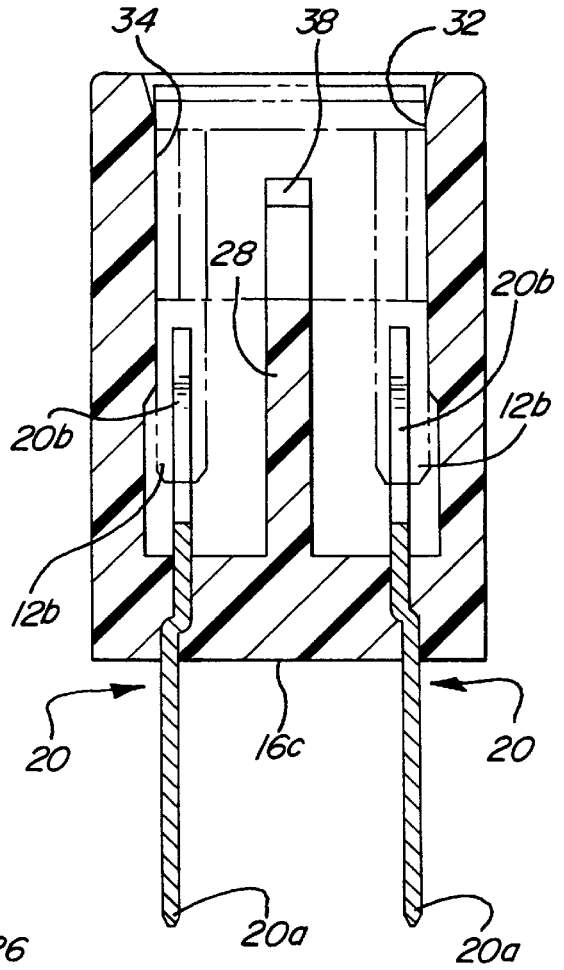
FIG-3
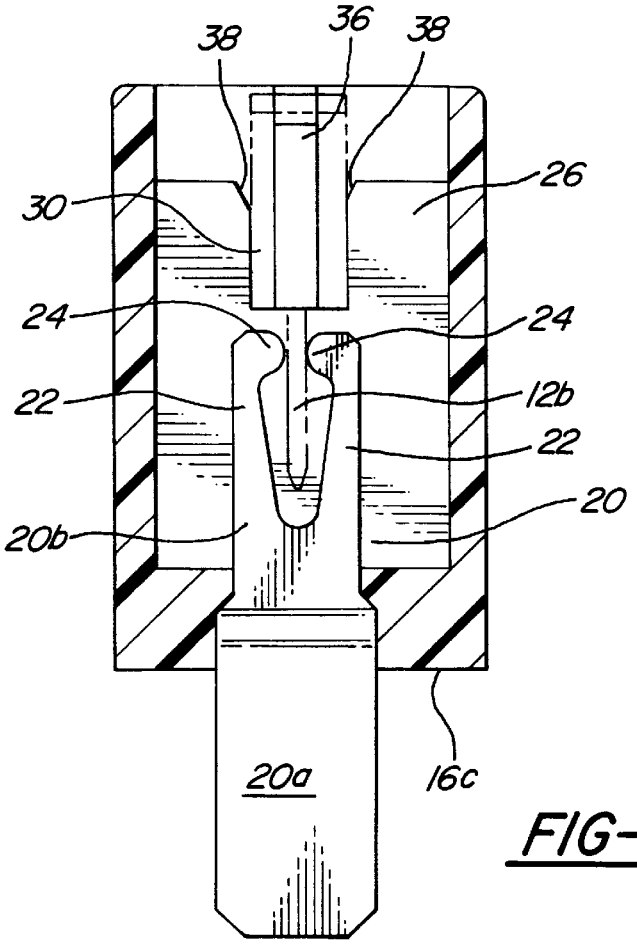
FIG-4

ADAPTER FOR ELECTRICAL CIRCUIT COMPONENTS

FIELD OF THE INVENTION

This invention relates in general to electrical circuit components and to power distribution boxes on which such circuit components are mounted, and more specifically to an adapter which allows more and different circuit components to be mounted to the PDB than permitted by the original PDB design.

BACKGROUND OF THE INVENTION

Power distribution boxes (PDBs) are commonly used in automotive vehicles to simplify the vehicle electrical system by eliminating multi-branch wiring and consolidating fuses, relays, and other electrical circuit components in a single location. A PDB typically comprises a housing which retains one or more bus bars and has a plurality of integrally formed external receptacles for receiving a variety of electrical circuit components. When the circuit components are inserted into their respective receptacles, electrical terminals of the circuit components pass through slots or other openings in the housing and make electrical connection with the bus bars or wires.

A current trend in automotive vehicle design is toward more electrical components and increasingly complicated and extensive electrical circuitry. As a result, PDBs are required to hold more circuit components. It is generally desirable, however, for a PDB to be as small as possible in order for it to take up a minimum amount of space within the vehicle. When a PDB is originally designed for a particular type of automotive vehicle, the number and type of receptacles provided thereon is determined by the number and type of circuit components required for the various electrical systems planned to be installed in the vehicle. If the number and/or type of the electrical systems is later changed so that the existing receptacles are too few to receive the required number of any one type of electrical circuit component, a costly and time-consuming redesign and change in tooling is required to manufacture a new PDB housing having the required receptacles. It is sometimes the case, however, that the original PDB, while having too few receptacles for a first type of circuit component, will have an excess number of receptacles for a different, second type of circuit component.

If it were possible to insert a circuit component of the first type into an unused receptacle intended for a circuit component of the second type, the circuitry internal to the PDB could be reconfigured relatively quickly and inexpensively by replacing the original bus bar or wire with new bus bars or wires having layouts which connect the new circuit components in the proper manner. Unfortunately, the physical configurations of the receptacles for the different types of circuit components are generally so dissimilar as to prevent such interchangeability. In particular, the terminals which extend from the circuit components are of greatly different size, shape, and layout and so cannot be inserted into connection with the PDB bus bars through any but their own specifically-formed receptacles.

SUMMARY OF THE INVENTION

Accordingly, it is an object of this invention to provide a circuit component adapter which enables an existing power distribution box (PDB) to receive more and different electrical circuit components than allowed by the original PDB design.

A further object of this invention is to provide an adapter capable of receiving at least two circuit components each having at least two terminals and electrically connecting the terminals to the PDB through a receptacle configured to accept a single circuit component having at least four terminals.

Another object of this invention is to provide an adapter for electrically connecting a pair of fuses each having two blade terminals to a PDB receptacle configured to receive a relay having five terminals.

In general, these objectives are realized through the use of an adapter having an external configuration permitting it to occupy a PDB receptacle adapted to receive a relay or other circuit component having at least four terminals. The adapter retains at least two circuit components each having at least two terminals, contacts disposed inside of the adapter making electrical connection with the terminals when the at least two components are retained by the adapter. The adapter has four or more terminals that are in electrical connection with the contacts and extend from the adapter in a configuration substantially identical with the terminals of the circuit component which the adapter replaces, so that the adapter terminals are matable with the receptacle to place the components in connection with the PDB.

In the preferred embodiment of the invention adapter disclosed herein, the adapter includes a hollow body injection molded from a thermoplastic or other electrically non-conductive material. The interior of the adapter body is configured to frictionally engage a pair of fuses so as to retain them within the adapter in the proper positions to make electrical connection with the contacts. Each of the contacts is formed integrally with a respective adapter terminal, the contact/terminal combinations taking the form of thin metal blades which are insert molded into the proper positions within the adapter body. Each of the contacts comprises a pair of resilient arms between which one of the fuse terminals passes when the fuse is inserted into the adapter, the arms exerting a clamping force on the fuse terminal. The clamping engagement between the contacts and the fuse terminals provides a reliable electrical connection therebetween and also serves to securely retain the fuses within the adapter.

The invention adapter allows various electrical circuit components, such as mini-fuses, standard fuses, and diodes to be operatively connected with electrical circuits through PDB receptacles designed to receive electrical relays. This eliminates the necessity for expensive redesign and manufacture of a new power distribution box when additional or different electrical components are added to the vehicle electrical system.

BRIEF DESCRIPTION OF THE DRAWINGS

FIG. 2 is a top view of the adapter of FIG. 1;

FIG. 3 is a cross-section of the adapter of FIG. 1 taken along line 3—3 of FIG. 2; and FIG. 4 is a cross-section of the adapter of FIG. 1 taken along line 4—4 of FIG. 2.

DETAILED DESCRIPTION OF THE PREFERRED EMBODIMENT

Figure 1:
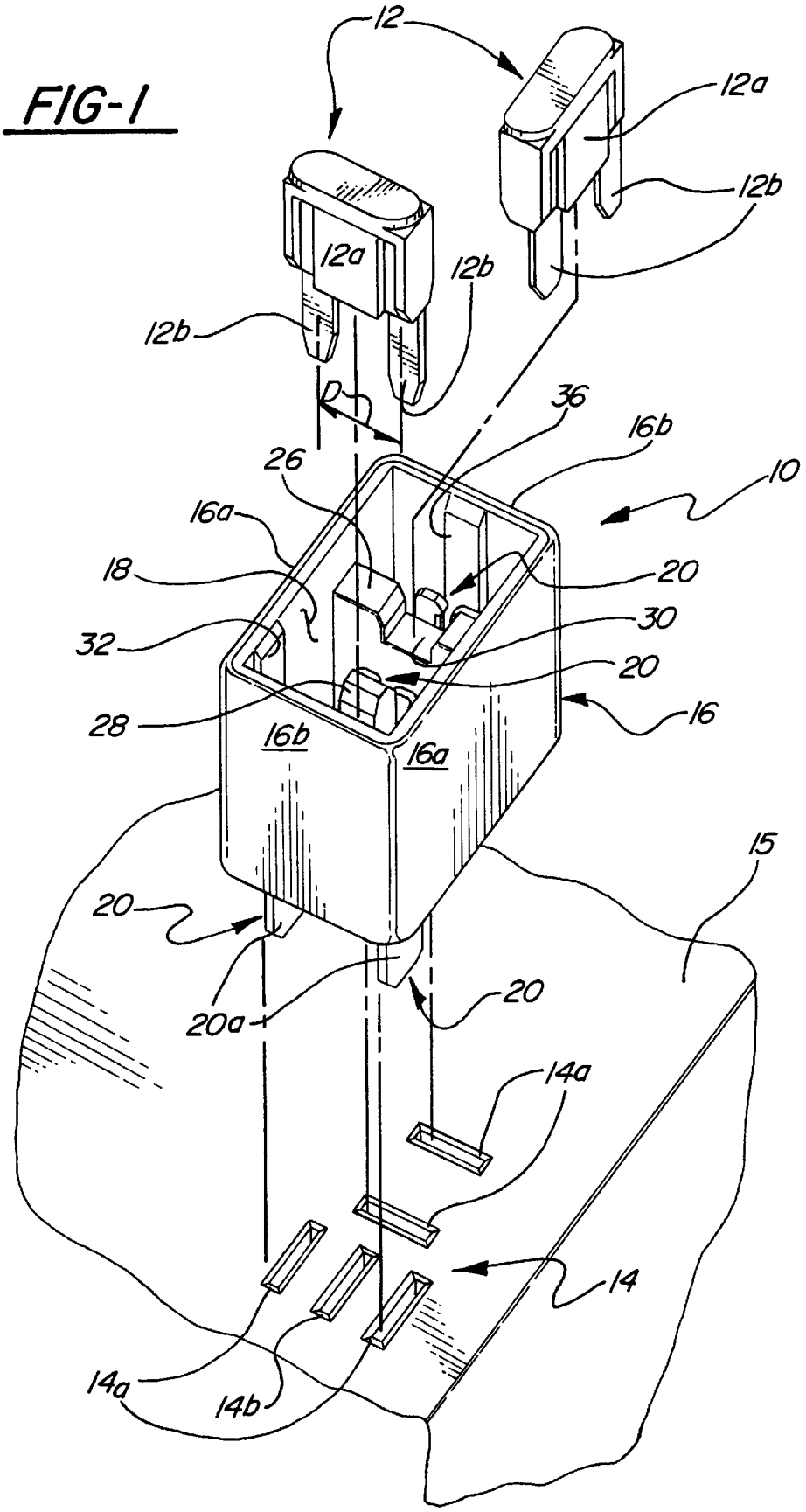
FIG. 1 is a perspective of an adapter according to the present invention in combination with a pair of fuses and a PDB receptacle.

FIGS. 1–4 illustrate an adapter 10 for receiving two conventional fuses 12 and electrically connecting them with a receptacle 14 on a power distribution box (PDB) 15. Fuses 12 are of the type having a rectangular body 12*a* and two terminal blades 12*b* extending from a lower end of the body. Receptacle 14 shown in FIG. 1 is of the configuration required to accept a Micro™ relay, and has four slots 14*a* for receiving blade-type terminals and an unused fifth slot 14*b*.

Adapter 10 comprises a rectangular housing 16 formed by side walls 16*a*, end walls 16*b*, and a bottom wall 16*c* which define a substantially hollow interior 18 with an open upper end. Four terminals 20 extend substantially perpendicularly through bottom wall 16*c*. Each terminal 20 is formed from a generally flat piece of electrically conductive metal, such as zinc coated copper, and comprises a blade end 20*a* projecting below housing 16 and a contact end 20*b* disposed within housing interior 18. Blade ends 20*a* are configured to match the geometry of the terminals of the electrical relay which adapter 10 is intended to replace. Contact end 20*b* comprise two arms 22 spaced apart from one another and having rounded, inwardly extending contacts 24 at their distal ends (see FIG. 4).

First and second fuse positioning blocks 26,28 are disposed within housing interior 18, first block 26 spanning side walls 16*a* at one end of the interior and second block 28 oriented perpendicular to the first block and positioned adjacent the opposite end wall 16*b*. Each block has a rectangular notch 30 formed in the upper edge thereof.

Two fuse positioning ramps 32,34 extend vertically along opposite side walls 16*a* at positions generally aligned with notch 30 of second fuse positioning block 28. A third fuse positioning ramp 36 is disposed on end wall 16*b* in general alignment with notch 30 of first fuse positioning block 26. See FIG. 3.

The four adapter terminals 20 are arranged in first and second pairs, the terminals of each pair being disposed on opposite sides of and parallel with first and second fuse positioning blocks 26,28 respectively. Contact ends 20*b* of each terminal pair are spaced from one another by a distance approximately equal to the distance between the vertical centerlines of the fuse blades 12*b* (this distance denoted as D in FIG. 1). Blade ends 20*a* of the terminals project below the housing 16 in a pattern which matches the layout of the slots of the relay receptacle 14 on the PDB 15.

Fuse positioning blocks 26,28 and fuse positioning ramps 32,34,36 are disposed within adapter housing 16 in the proper configuration to retain fuses 12 securely within the housing interior with fuse blades 12*b* engaged by terminal contact ends 20*b*. A first of the fuses 12 is inserted into the housing interior 18 so that fuse body 12*a* slides downwardly between fuse positioning ramp 36 and the vertical end surface of second fuse positioning block 28, and fuse blades 12*b* are simultaneously received between the arms 22 of terminal contact ends 20*b* bracketing first fuse positioning block 26. Downward movement of the fuse is arrested by fuse body 12*a* becoming seated within notch 30 of first fuse positioning block 26.

Similarly, the second fuse 12 is inserted into housing interior 18 such that fuse body 12*a* slides between fuse positioning ramps 32,34 and fuse blades 12*b* are received between arms 22 of terminal contact end 20*b* bracketing second fuse positioning block 28. Fuse 12 is properly positioned when fuse body 12*a* bottoms out in notch of second fuse positioning block 28.

Prior to insertion of fuses 12, the confronting surfaces of contacts 24 are either touching or separated by a distance less than the thickness of fuse blades 12*b*. Accordingly, as the fuses 12 are urged downwardly and blades 12*b* are inserted between contacts 24, arms 22 are deflected outward slightly and apply a clamping force on the fuse blade 12*b*, as indicated in FIG. 4. Notches 30 are preferably of widths substantially equal to or slightly less than the overall thickness of fuse bodies 12*a* such that frictional engagement between the notch side walls and the fuse bodies serves to retain the fuses snugly therein. Similarly, the distance between confronting faces of fuse positioning ramps 32,34 and between the face of fuse positioning ramp 36 and the end of second fuse positioning block 28 are equal to or slightly less than the overall width of the fuse bodies 12*a* to frictionally engage the bodies and thus securely retain the fuses. Notches 30 preferably have bevels 38 formed at the upper ends thereof, as best seen in FIG. 4, to make it easier to insert fuses 12 therein.

As is visible in FIG. 3, the spacing between the contact ends 20*b* of terminals 20 is slightly less than the spacing between the blade ends 20*a* thereof. This is necessary to allow blade ends 20*a* to be of the correct spacing to fit into the slots of relay receptacle 14 while the spacing between contact ends 20*b* matches the centerline spacing D of fuse blades 12*b*.

It will be appreciated that the drawings and descriptions contained herein are merely meant to illustrate a particular embodiment of the present invention and are not meant to be limitations upon the practice thereof, as numerous variations will occur to persons of skill in the art. For example, although the invention is described above in relation to an adapter for mating two blade-type fuses to a receptacle for a Micro™ relay, it is to be understood that the invention may also be practiced in relation to an adapter for mating two or more of any type of circuit component to any PDB receptacle intended to receive any circuit component having four or more terminals.

The invention claimed is:

1. In combination with at least two first circuit components, each having at least two terminals arranged in a first-component terminal configuration, and with a receptacle of a power distribution box, the power distribution box receptacle having an original, non-reconfigurable receptacle layout designed to receive a second circuit component having at least four terminals arranged in a second-component terminal configuration matching the non-reconfigurable receptacle layout, an adapter comprising:

an adapter body designed to receive the first circuit components, the adapter body being externally configured to occupy the power distribution box receptacle in place of the second circuit component;

at least two pairs of contacts arranged on the adapter body in the first-component terminal configuration for making electrical connection with the first circuit component terminals when the first circuit components are received by the adapter body; and a plurality of adapter terminals electrically connected with the contacts and extending from the adapter body in the second-component terminal configuration capable of being received in the original, non-reconfigurable receptacle layout of the power distribution box whereby the adapter collectively connects the first circuit components to the receptacle in place of the second circuit component.

2. An adapter according to claim 1 wherein the adapter body comprises a body having a substantially hollow interior for receiving the first circuit components and external dimensions no larger than external dimensions of the second circuit component.

3. An adapter according to claim 1 wherein the configuration of the adapter terminals allows the adapter terminals to mate with a receptacle for a four-terminal relay.

4. An adapter according to claim 1 wherein the adapter body is adapted to receive two fuses and the configuration of the adapter terminals allows the adapter terminals to mate with a receptacle for a four-terminal relay.

5. An adapter according to claim 1 wherein at least one of the adapter terminals is formed integrally with at least one of the contacts.

6. A combination comprising an adapter, at least two first circuit components each having at least two terminals, and a power distribution box receptacle having a terminal-receiving configuration adapted to receive at least four terminals from a second circuit component, the at least four terminals of the second circuit component being disposed in a particular terminal configuration, the adapter comprising:

an adapter body for receiving the first circuit components;

a plurality of terminal contacts disposed on the adapter body for making electrical connection with the first circuit component terminals; and a plurality of adapter terminals electrically connected with the terminal contacts and extending from the adapter body in a configuration substantially identical to the particular terminal configuration of the second circuit component terminals, such that the adapter terminals are received in the power distribution box receptacle for the second circuit component as if the adapter were the second circuit component.

* * * * *